US011096006B1

(12) United States Patent
Robinson

(10) Patent No.: US 11,096,006 B1
(45) Date of Patent: Aug. 17, 2021

(54) DYNAMIC SPEECH DIRECTIVITY REPRODUCTION

(71) Applicant: Facebook Technologies, LLC, Menlo Park, CA (US)

(72) Inventor: Philip Robinson, Seattle, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/672,549

(22) Filed: Nov. 4, 2019

(51) Int. Cl.
*H04S 7/00* (2006.01)
*G10L 21/0232* (2013.01)
*G10L 21/0208* (2013.01)

(52) U.S. Cl.
CPC ..... *H04S 7/303* (2013.01); *G10L 21/0232* (2013.01); *H04S 7/305* (2013.01); *G10L 2021/02082* (2013.01); *H04S 2400/11* (2013.01); *H04S 2420/01* (2013.01)

(58) Field of Classification Search
CPC ... H04S 2420/01; H04S 2400/11; H04R 3/04; H04R 3/12
USPC ..... 381/310, 303
See application file for complete search history.

(56) References Cited

U.S. PATENT DOCUMENTS 10,341,612 B2 * 7/2019 Imaoka ..... G02B 27/0093
10,616,705 B2 * 4/2020 Schmidt ..... G06F 3/012
2020/0221243 A1 * 7/2020 Schaefer ..... H04S 3/008

OTHER PUBLICATIONS

Katz et al., "Human voice phoneme directivity pattern measurements", The Journal of the Acoustical Society of America, vol. 120, No. 5, Nov. 2006, 14 pages.

* cited by examiner

*Primary Examiner* — Alexander Krzystan
(74) *Attorney, Agent, or Firm* — FisherBroyles LLP

(57) ABSTRACT

The disclosed computer-implemented method may include capturing, via a headset microphone of a speaker's artificial reality device, voice input of a speaker in communication with a listener in an artificial reality environment. The method may include detecting a pose of the speaker within the artificial reality environment and determining a position of the speaker relative to a position of the listener within the artificial reality environment. The method may further include processing, based on the pose and the relative position of the speaker within the artificial reality environment, the voice input to create a directivity-attuned voice signal for the listener, and delivering the directivity-attuned voice signal to an artificial reality device of the listener. Various other methods, systems, and computer-readable media are also disclosed.

20 Claims, 9 Drawing Sheets

601

| | Directivity Classification |
|---|---|
| "look" | A |
| "book" | B |
| "took" | C |

602

| Gender | Pitch | Directivity Classification |
|---|---|---|
| Male | Baritone | D |
| Female | Alto | E |

601

| | Directivity Classification |
|---|---|
| "look" | A |
| "book" | B |
| "took" | C |

FIG. 6A

602

| Gender | Pitch | Directivity Classification |
|---|---|---|
| Male | Baritone | D |
| Female | Alto | E |

FIG. 6B

DYNAMIC SPEECH DIRECTIVITY REPRODUCTION

BRIEF DESCRIPTION OF THE DRAWINGS

The accompanying drawings illustrate a number of exemplary embodiments and are a part of the specification. Together with the following description, these drawings demonstrate and explain various principles of the present disclosure.

FIGS. 6A-B are tables of directivity classifications.

Figure 1:
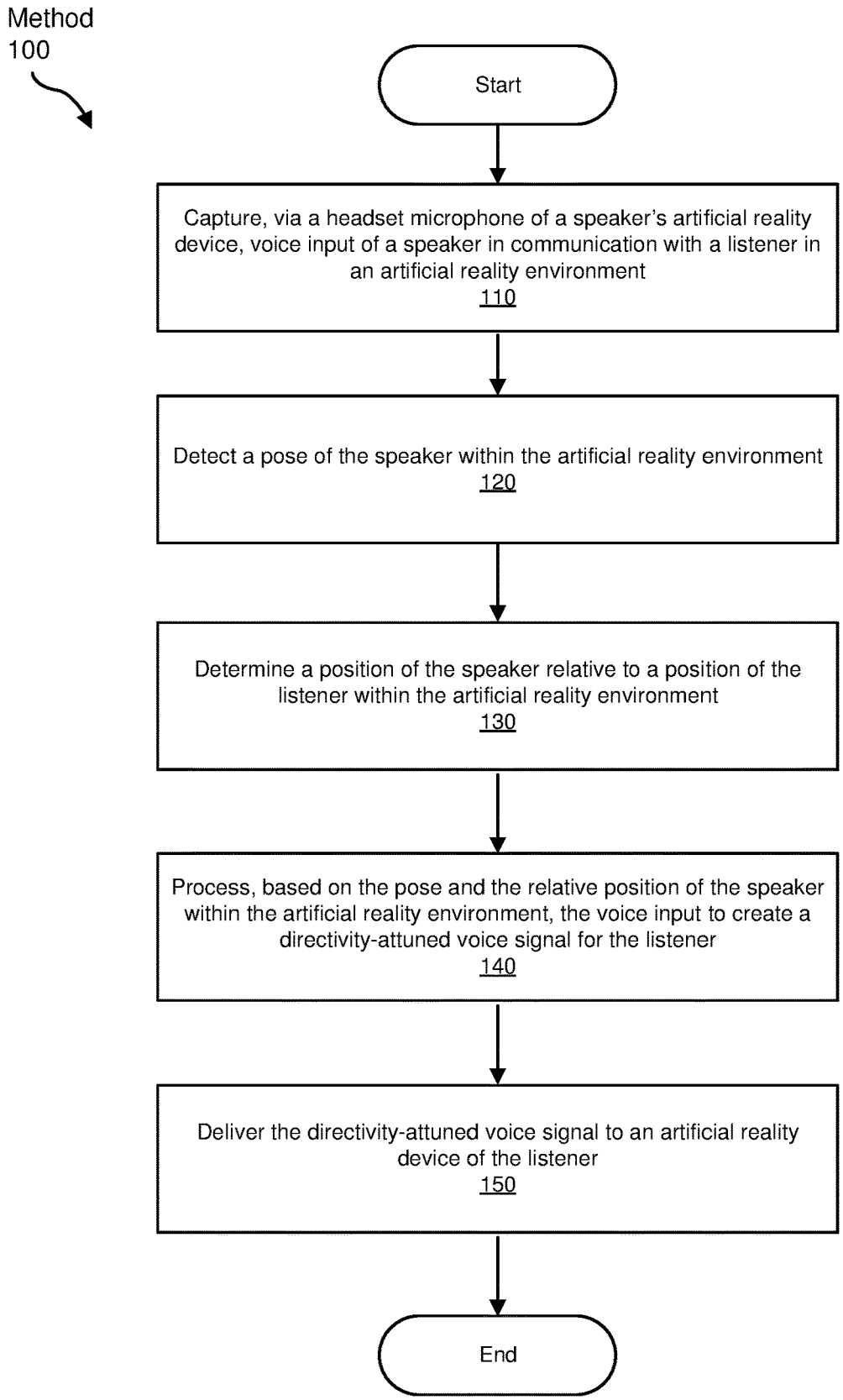
FIG. 1 is a flow diagram of an exemplary method for reproducing dynamic speech directivity.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the present disclosure covers all modifications, equivalents, and alternatives falling within the scope of the appended claims.

DETAILED DESCRIPTION OF EXEMPLARY EMBODIMENTS

When a person speaks, sound waves radiate from the person's mouth, head, and torso in a complex spatial pattern that may vary with voice frequency, vocal effort (which may correspond to changes in a loudness and/or timbre of a speaker's voice, such as in response to increased or decreased communication distance to a listener), the person's pose, and content of the person's speech. This spatial pattern of sound waves, or directivity, may change constantly as each factor changes and further interacts with other factors while the person speaks. In addition, a person's speech may have different directivities, even at the same frequency, depending on the person's pose or content of their speech. This dynamic directivity may influence the spectral coloration of direct sound to a listener, and the sound propagating in other directions may interact with the surrounding environment as it travels to the listener. For example, the strength and frequency response for environmental reflections (i.e., reverb) may change along with the dynamic directivity.

A human listener may be able to hear and recognize dynamic directivity. For instance, a listener may be able to locate a speaker and further estimate, to within about 15 degrees of accuracy, which direction the speaker's head is facing. Thus, audible changes in directivity, though subtle, may provide cues to the listener as to the speaker's proximity and presence.

A telepresence system may use artificial reality devices (e.g., augmented, virtual, and/or mixed-reality devices) to simulate a meeting between users. For example, physically remote persons may meet in virtual proximity in an artificial-reality based room, such that each person may see and hear virtual representations of the others as if locally present. An artificial reality device may present each user with visual and aural feedback to simulate the presence of others. The artificial reality device may be equipped with one or more microphones for capturing user speech. However, conventional telepresence systems may replay the captured user speech without accounting for different reverberant properties of each user's environment as well as the artificial-reality based room itself. Unless a virtual representation of a listener is positioned, in the artificial-reality based room, next to a virtual representation of the speaker, specifically duplicating where the microphone captured the speaker's speech, the listener may notice the sound being inconsistent with the location of the speaker's virtual representation. Conventional telepresence systems may not be configured to use microphone signals to recreate a user's dynamic speech directivity in the artificial-reality based room. Reincorporating dynamic speech directivity into the captured speech may improve realism, authenticity, and proximity for the listener's telepresence experience.

The present disclosure is generally directed to reproducing dynamic speech directivity. As will be explained in greater detail below, embodiments of the present disclosure may capture a speaker's voice input along with the speaker's pose in an artificial-reality environment. Based on the pose and relative positions between the speaker and a listener in the artificial reality environment, an artificial reality system may create and deliver a directivity-attuned voice signal that may reproduce the speaker's dynamic speech directivity within the artificial-reality environment. By providing this directivity-attuned voice signal to the listener, the artificial reality system may provide a more realistic telepresence experience for the listener. This system may also improve the functioning of a computing device by efficiently simulating sound propagation without requiring additional sound inputs. The system may further improve artificial reality technology by providing a system capable of reproducing dynamic speech directivity without requiring specialized hardware.

Features from any of the embodiments described herein may be used in combination with one another in accordance with the general principles described herein. These and other embodiments, features, and advantages will be more fully understood upon reading the following detailed description in conjunction with the accompanying drawings and claims.

Figure 2:
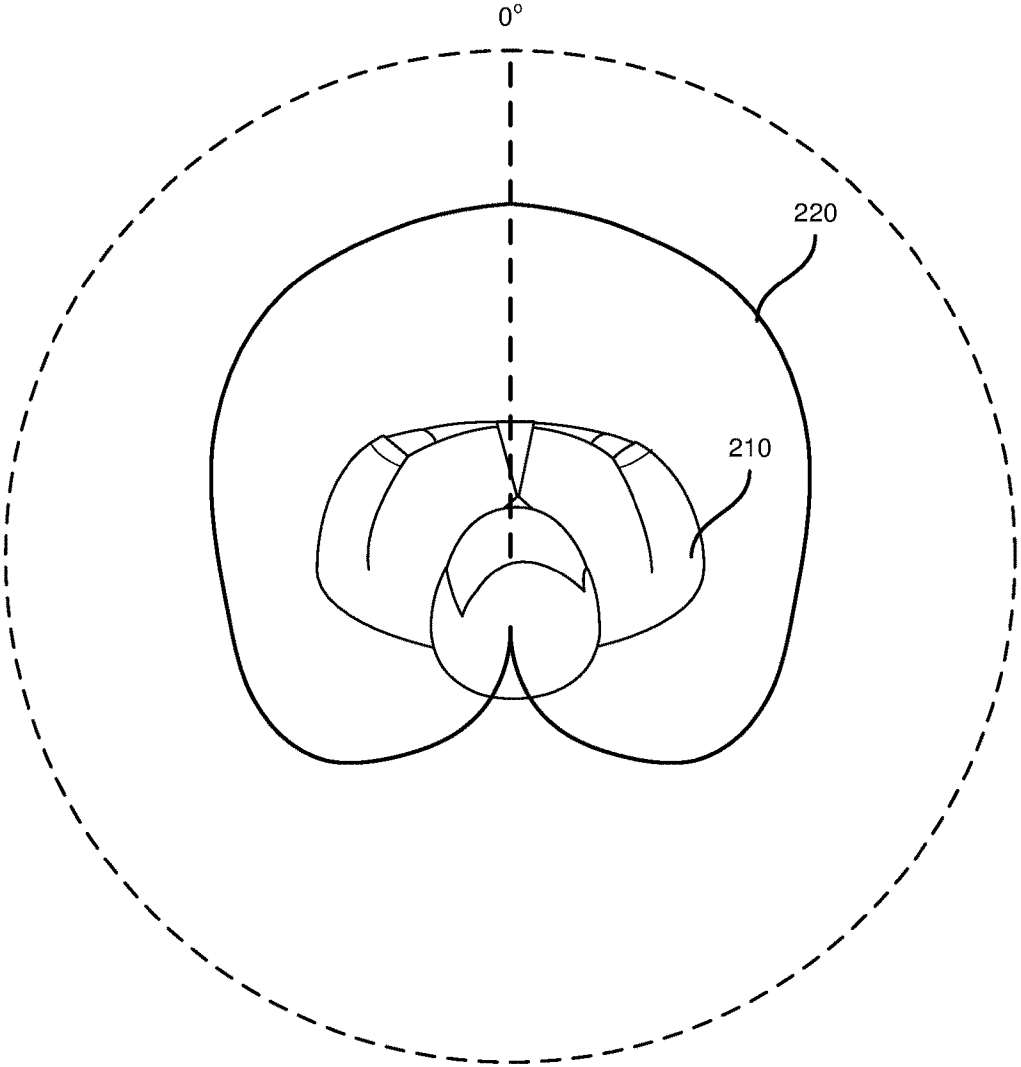
FIG. 2 is a diagram of speech directivity.
Figure 3:
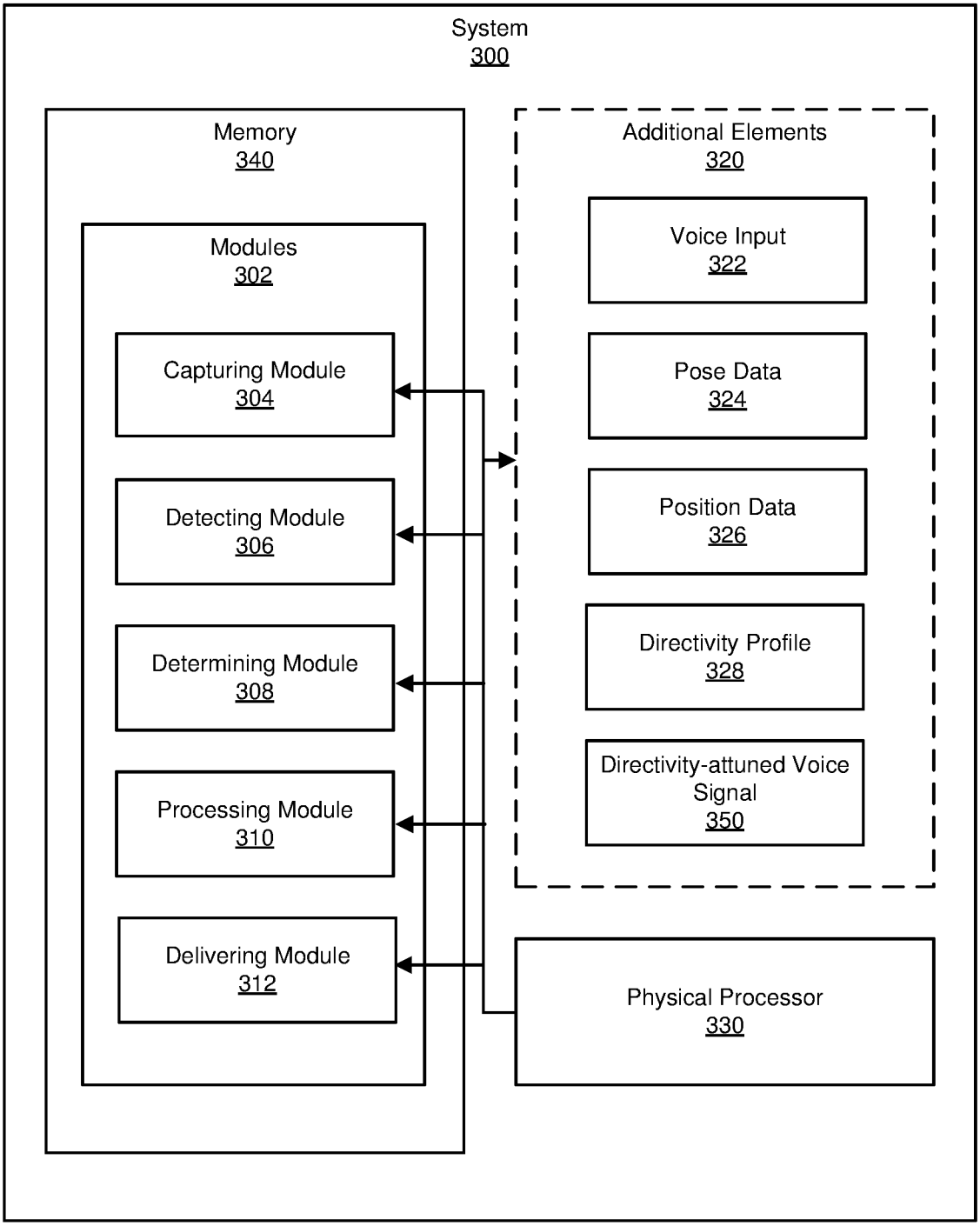
FIG. 3 is a block diagram of an exemplary system for reproducing dynamic speech directivity.
Figure 4:
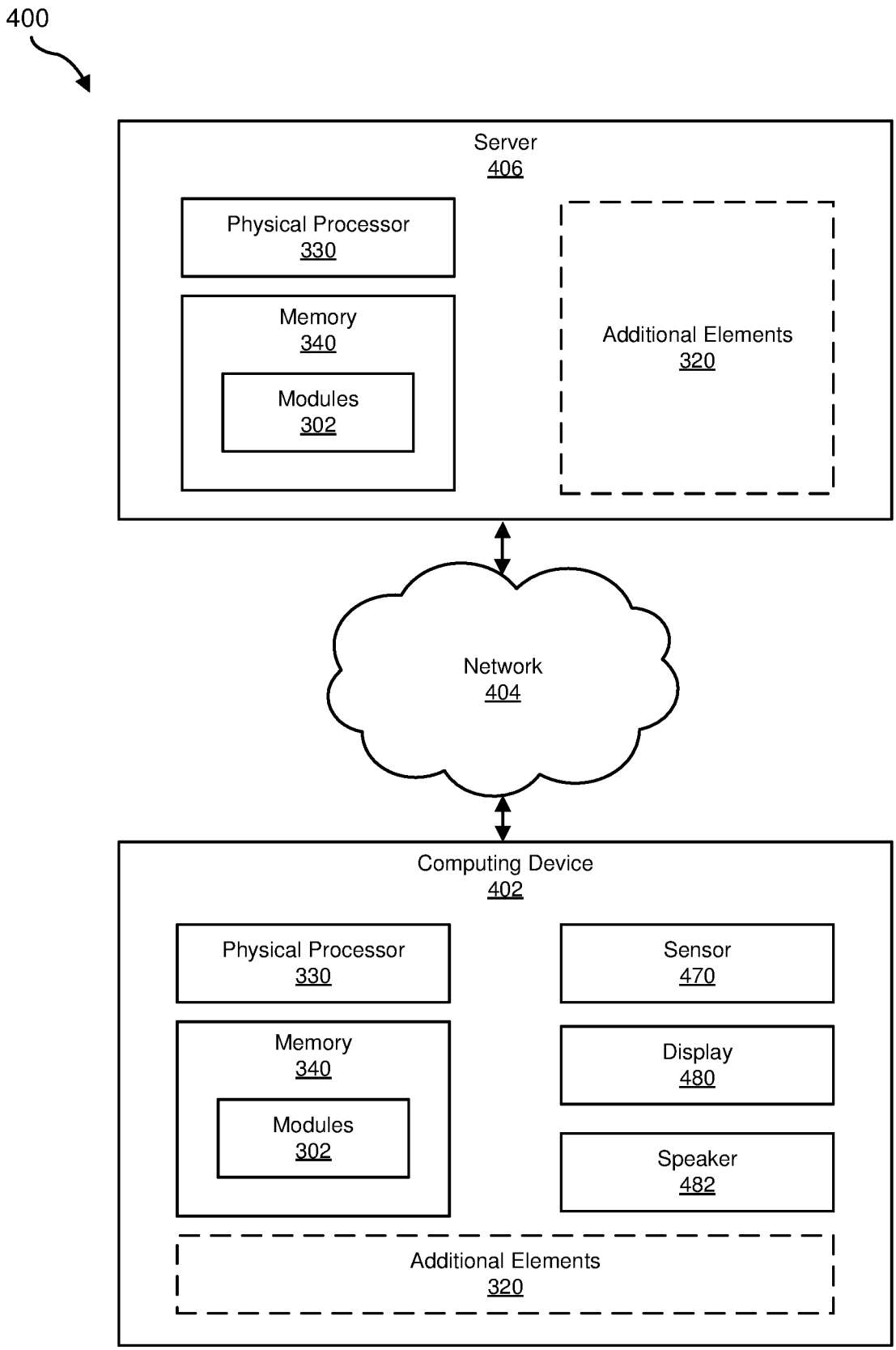
FIG. 4 is a block diagram of an exemplary network for reproducing dynamic speech directivity.
Figure 7:
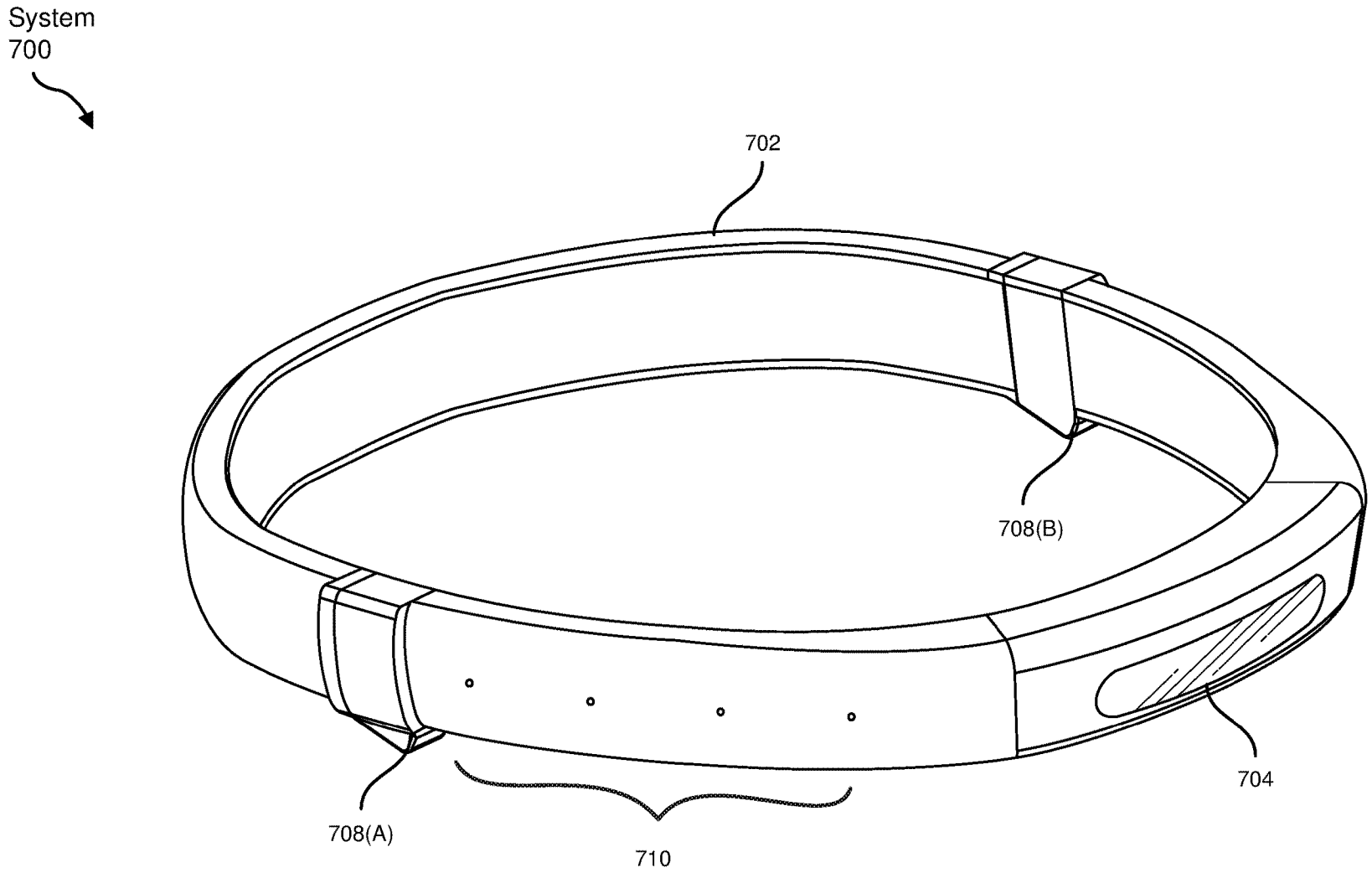
FIG. 7 is an illustration of an exemplary artificial-reality headband that may be used in connection with embodiments of this disclosure.
Figure 8:
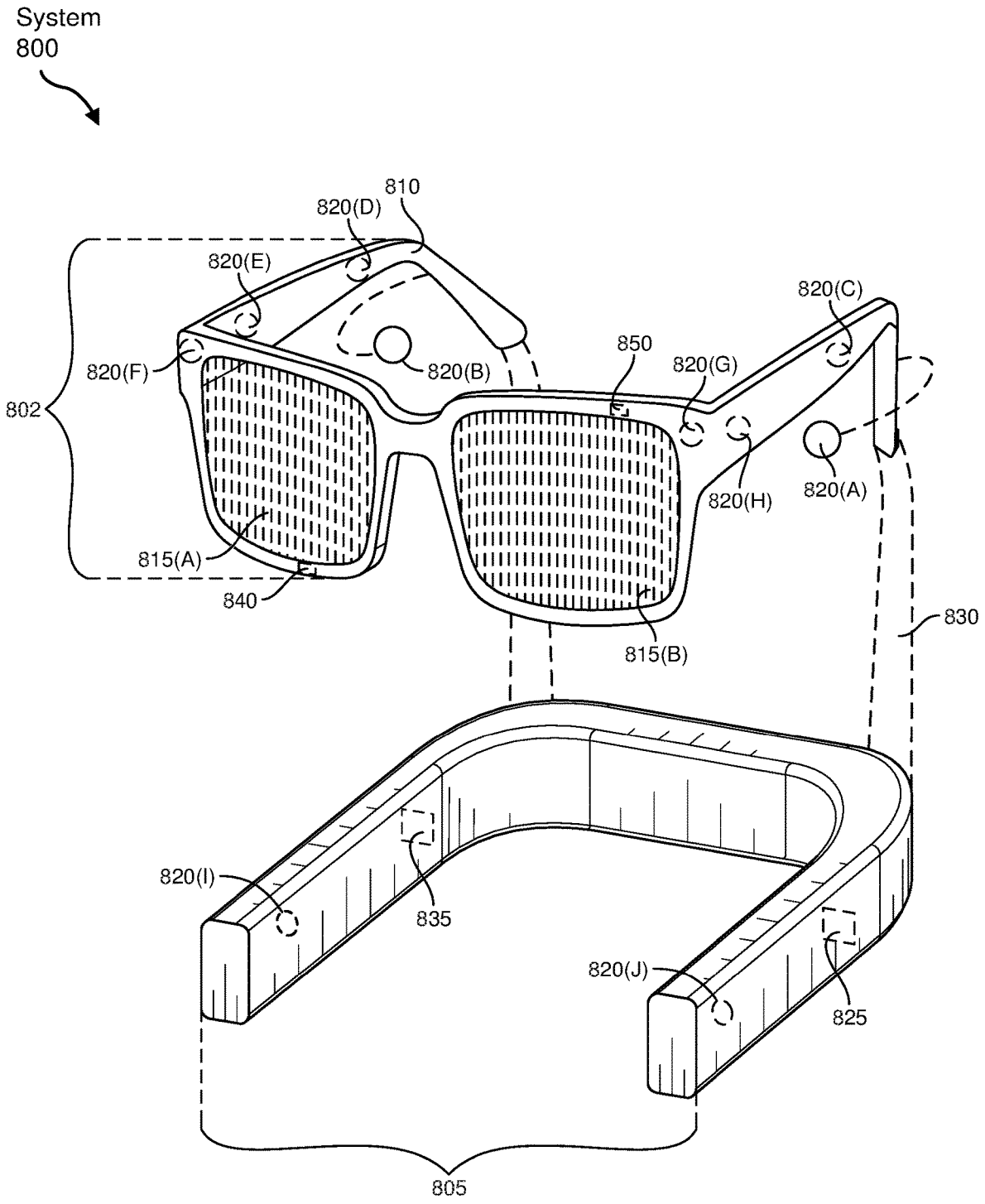
FIG. 8 is an illustration of exemplary augmented-reality glasses that may be used in connection with embodiments of this disclosure.
Figure 9:
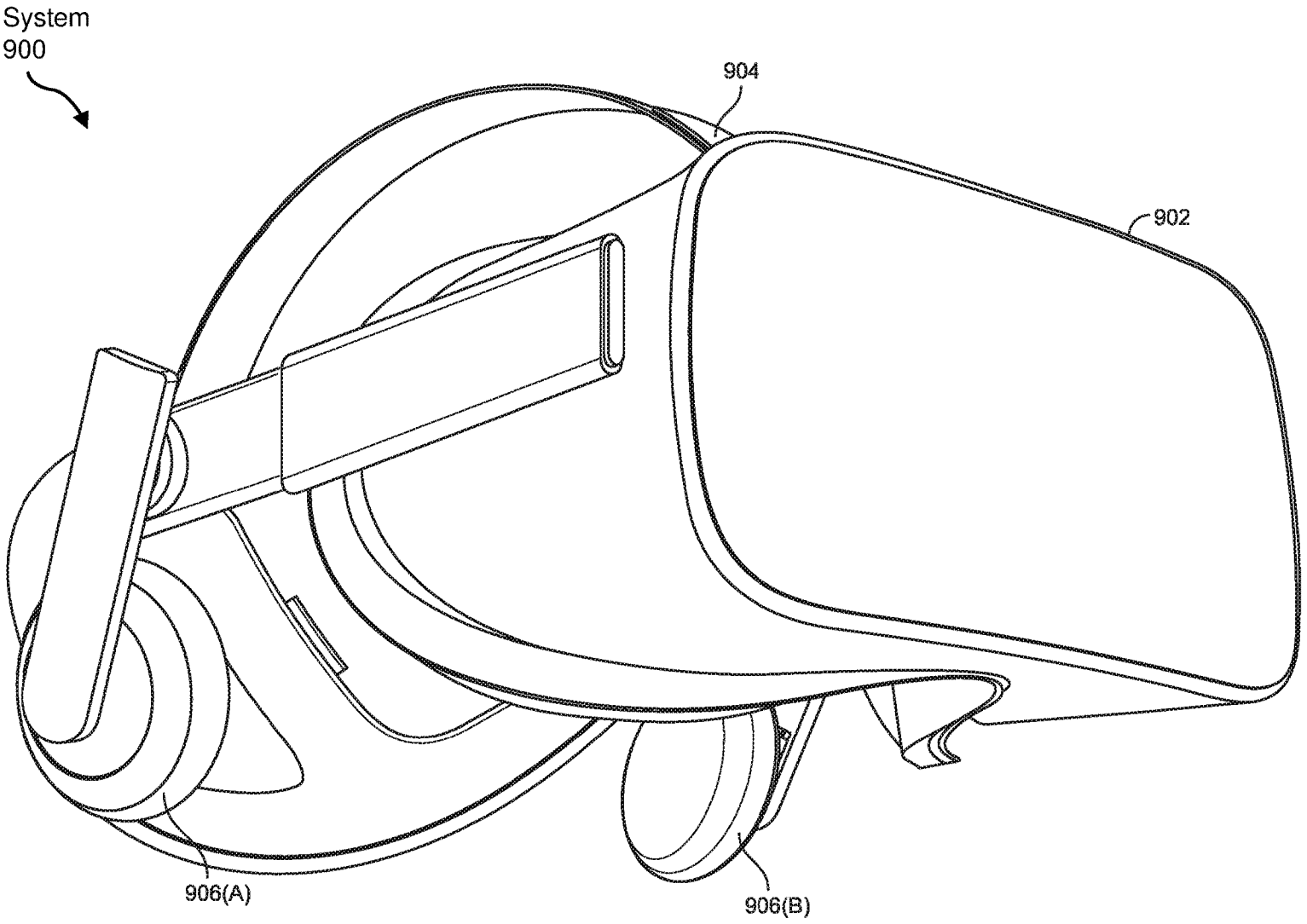
FIG. 9 is an illustration of an exemplary virtual-reality headset that may be used in connection with embodiments of this disclosure.

The following will provide, with reference to FIGS. 1-9, detailed descriptions of systems and methods for reproducing dynamic speech directivity in artificial reality systems. FIG. 1 illustrates an exemplary process of reproducing dynamic speech directivity. FIG. 2 illustrates an example of speech directivity. FIG. 3 illustrates an exemplary system for reproducing dynamic speech directivity. FIG. 4 illustrates an exemplary network environment. FIG. 5A illustrates an exemplary speaker environment in an artificial reality session. FIG. 5B illustrates an exemplary listener environment in the artificial reality session. FIGS. 6A-B illustrate various directivity profiles as tables. FIG. 7 illustrates an exemplary artificial reality system. FIG. 8 illustrates another exemplary artificial reality system. FIG. 9 illustrates another exemplary artificial reality system.

FIG. 1 is a flow diagram of an exemplary computer-implemented method 100 for reproducing dynamic speech directivity in artificial reality systems. The steps shown in FIG. 1 may be performed by any suitable computer-executable code and/or computing system, including the system(s) illustrated in FIGS. 3, 4, 7, 8, and 9. In one example, each of the steps shown in FIG. 1 may represent an algorithm whose structure includes and/or is represented by multiple sub-steps, examples of which will be provided in greater detail below.

As illustrated in FIG. 1, at step 110 one or more of the systems described herein may capture, via a headset microphone of a speaker's artificial reality device, voice input of a speaker in communication with a listener in an artificial reality environment. For example, capturing module 304 in FIG. 3, which may be part of computing device 402 and/or server 406 in FIG. 4, may capture voice input 322, using a microphone of the speaker's artificial reality device (e.g., input audio transducer 710 of augmented-reality system 700 in FIG. 7, acoustic transducers 820 of augmented-reality system 800 in FIG. 8, and/or a microphone used with virtual-reality system 900 in FIG. 9).

In some embodiments, the term "voice input" may refer to any sound captured from a user's voice. Examples of voice input include, without limitation, talking, whispering, singing, voice commands, sounds made from the mouth, etc.

When a person speaks, sound waves may propagate outward from the source of sound (e.g., the person's mouth). However, the sound waves may not propagate with the same energy in all directions, instead exhibiting a directivity pattern of sound wave propagation that varies based on directional offset from a forward (e.g., 0 degrees) direction. FIG. 2 illustrates a two-dimensional directivity pattern 220 for a speaker 210 when speaker 210 speaks facing forward.

As seen in FIG. 2, directivity pattern 220 may resemble a cardioid shape, having a forward bias. For instance, directly behind speaker 210's head, sound energy may be less than directly in front of speaker 210's head. Accordingly, a listener may be able to hear speaker 210 more easily in front rather than behind speaker 210. In addition, because the sound energy may vary based on direction, the listener may also be able to distinguish and broadly identify (e.g., to within about 15 degrees) which direction speaker 210 may be facing, with respect to the listener.

Because humans are capable of roughly detecting directivity, realism of an artificial reality session may be increased by reproducing the directivity for the listener. However, artificial reality devices may not be configured to adequately capture directivity. For instance, a headset microphone, such as input audio transducer 710 and/or acoustic transducers 820, may maintain a constant position relative to speaker 210's mouth. As speaker 210 moves his head, the microphone may move with the head such that the microphone may remain in a fixed location with respect to the mouth. The sound captured by this microphone may resemble what a listener would hear if the listener were able to maintain a constant position with respect to speaker 210's mouth. However, the listener may not be located where the microphone is located. The listener may be able to detect a dissonance between sound captured by the microphone and sound expected based on the listener's position relative to speaker 210.

In addition, unlike a loudspeaker, which has fixed frequency dependent directivity, a human speaker may have different directivity depending on speech content and/or pose. For instance, a shape of speaker 210's mouth and pose of speaker 210's head and/or body while pronouncing certain words may affect directivity such that speaker 210's directivity may dynamically change from directivity pattern 220 while speaking. Other characteristics of speaker 210, including but not limited to gender, voice frequency range, headset size, and/or other physical characteristics, may also affect directivity. Thus, a single directivity model (e.g., resembling directivity pattern 220) may not be universally applied.

Various systems described herein may perform step 110. FIG. 3 is a block diagram of an example system 300 for reproducing dynamic speech directivity. As illustrated in this figure, example system 300 may include one or more modules 302 for performing one or more tasks. As will be explained in greater detail herein, modules 302 may include capturing module 304, a detecting module 306, a determining module 308, a processing module 310, and a delivering module 312. Although illustrated as separate elements, one or more of modules 302 in FIG. 3 may represent portions of a single module or application.

In certain embodiments, one or more of modules 302 in FIG. 3 may represent one or more software applications or programs that, when executed by a computing device, may cause the computing device to perform one or more tasks. For example, and as will be described in greater detail below, one or more of modules 302 may represent modules stored and configured to run on one or more computing devices, such as the devices illustrated in FIG. 4 (e.g., computing device 402 and/or server 406). One or more of modules 302 in FIG. 3 may also represent all or portions of one or more special-purpose computers configured to perform one or more tasks.

As illustrated in FIG. 3, example system 300 may also include one or more memory devices, such as memory 340. Memory 340 generally represents any type or form of volatile or non-volatile storage device or medium capable of storing data and/or computer-readable instructions. In one example, memory 340 may store, load, and/or maintain one or more of modules 302. Examples of memory 340 include, without limitation, Random Access Memory (RAM), Read Only Memory (ROM), flash memory, Hard Disk Drives (HDDs), Solid-State Drives (SSDs), optical disk drives, caches, variations or combinations of one or more of the same, and/or any other suitable storage memory.

As illustrated in FIG. 3, example system 300 may also include one or more physical processors, such as physical processor 330. Physical processor 330 generally represents any type or form of hardware-implemented processing unit capable of interpreting and/or executing computer-readable instructions. In one example, physical processor 330 may access and/or modify one or more of modules 302 stored in memory 340. Additionally or alternatively, physical processor 330 may execute one or more of modules 302 to facilitate maintain the mapping system. Examples of physical processor 330 include, without limitation, microprocessors, microcontrollers, Central Processing Units (CPUs), Field-Programmable Gate Arrays (FPGAs) that implement softcore processors, Application-Specific Integrated Circuits (ASICs), portions of one or more of the same, variations or combinations of one or more of the same, and/or any other suitable physical processor.

As illustrated in FIG. 3, example system 300 may also include one or more additional elements 320, such as voice input 322, pose data 324, position data 326, directivity profile 328, and directivity-attuned voice signal 350. Voice input 322, pose data 324, position data 326, directivity profile 328, and/or directivity-attuned voice signal 350 may be stored on a local storage device, such as memory 340, or may be accessed remotely. Voice input 322 may represent audio data received from devices in an environment, as will be explained further below. Pose data 324 may represent pose data of a speaker and/or listener in an artificial reality environment. Position data 326 may represent mapping data corresponding to the speaker's position relative to the listener's position in the artificial reality environment. Directivity profile 328 may represent directivity patterns for speakers classified by various characteristics, as will be explained further below. Directivity-attuned voice signal 350 may represent a processed result of reincorporating directivity to voice input 322, as will be explained further below.

Example system 300 in FIG. 3 may be implemented in a variety of ways. For example, all or a portion of example system 300 may represent portions of example network environment 400 in FIG. 4.

FIG. 4 illustrates an exemplary network environment 400 implementing aspects of the present disclosure. The network environment 400 includes computing device 402, a network 404, and server 406. Computing device 402 may be a client device or user device, such as an artificial reality system (e.g., augmented-reality system 700 in FIG. 7, augmented-reality system 800 in FIG. 8, virtual-reality system 900 in FIG. 9), a desktop computer, laptop computer, tablet device, smartphone, or other computing device. Computing device 402 may include a physical processor 330, which may be one or more processors, memory 340, which may store data such as one or more of additional elements 320, a sensor 470 capable of detecting voice input 322 from the environment, and a display 480. In some implementations, computing device 402 may represent an augmented reality device such that display 480 overlays images onto a user's view of his or her local environment. For example, display 480 may include a transparent medium that allows light from the user's environment to pass through such that the user may see the environment. Display 480 may then draw on the transparent medium to overlay information. Alternatively, display 480 may project images onto the transparent medium and/or onto the user's eyes. Computing device 402 may also include a speaker 482 for sound output.

Sensor 470 may include one or more sensors, such as a microphone, an inertial measurement unit (IMU), a gyroscope, a GPS device, etc., and other sensors capable of detecting features and/or objects in the environment. Computing device 402 may be capable of collecting voice input 322 using sensor 470 for sending to server 406.

Server 406 may represent or include one or more servers capable of hosting an artificial reality environment. Server 406 may track user positions in the artificial reality environment using signals from computing device 402. Server 406 may include a physical processor 330, which may include one or more processors, memory 340, which may store modules 302, and one or more of additional elements 320.

Computing device 402 may be communicatively coupled to server 406 through network 404. Network 404 may represent any type or form of communication network, such as the Internet, and may comprise one or more physical connections, such as LAN, and/or wireless connections, such as WAN.

Returning to FIG. 1, the systems described herein may perform step 110 in a variety of ways. In one example, there may be more than one microphone and the one or more microphones may be attached elsewhere on the speaker's body. Voice input 322 may be captured as raw audio data, or may be processed, such as compressed, for transmittal and storage. In some implementations, voice input 322 may undergo lossless compression, although in other implementations voice input 322 may undergo lossy compression.

At step 120 one or more of the systems described herein may detect a pose of the speaker within the artificial reality environment. For example, detecting module 306 may detect pose data 324, corresponding to a pose of the speaker within the artificial reality environment.

In some embodiments, the term "pose" may refer to an orientation, posture, and/or location of a user. Examples of pose include, without limitation, a head posture (e.g., a tilt, rotation, lean, etc. of the head), a torso posture (e.g., a tilt, rotation, lean, whether the torso is twisted, etc.), postural relationships between body parts (e.g., the head's orientation with respect to the shoulders/torso), a full body pose (e.g., a wireframe of the torso and limbs), etc.

The systems described herein may perform step 120 in a variety of ways. In one example, detecting module 306, as part of computing device 402, may, using sensor 470, detect pose data 324. Sensor 470 may include an IMU, an accelerometer, a gyroscope, a magnetometer, a depth camera assembly, etc., for detecting orientation. Sensor 470, which may correspond to sensor 840, may be attached to the speaker's head such that sensor 470 may capture a pose of the speaker's head. Sensor 470 may also include additional sensors, such as additional IMU's located elsewhere on the speaker's body, one or more cameras (e.g., camera assembly 704) for detecting the speaker's body, etc.

Pose data 324 may include the pose of the speaker's head, such as an orientation and position of the speaker's head relative to the speaker's torso. Pose data 324 may include the pose of the speaker's body. In addition, pose data 324 may include a pose of the listener, such as a pose of the listener's head and/or body, similar to those of the speaker.

At step 130, one or more of the systems described herein may determine a position of the speaker relative to a position of the listener within the artificial reality environment. For example, determining module 308 may determine position data 326, corresponding to a position of the speaker relative to a position of the listener within the artificial reality environment.

Figure 5A:
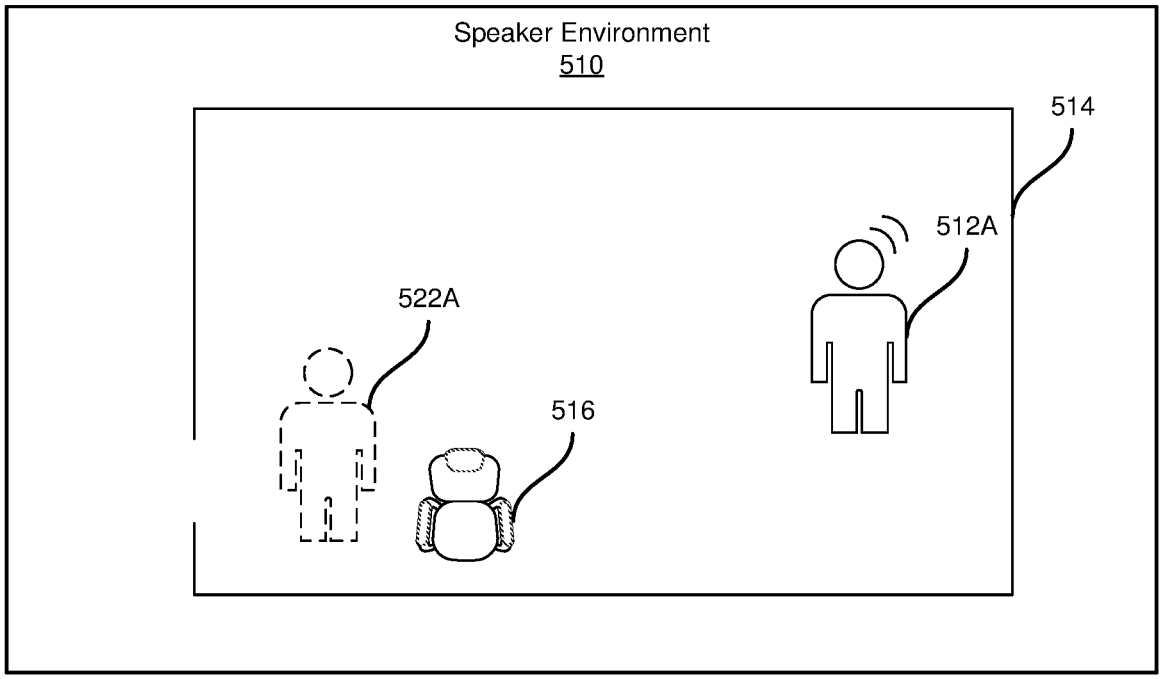
FIGS. 5A-B are diagrams of artificial reality environments.
Figure 5B:
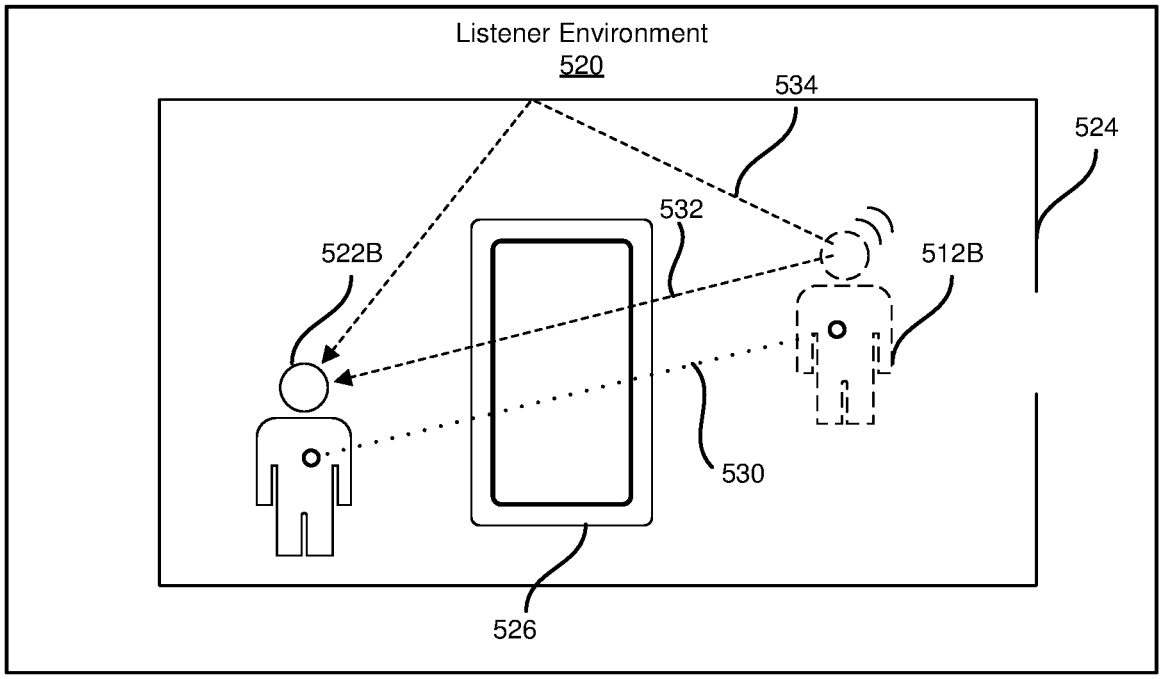

The systems described herein may perform step 130 in a variety of ways. In one example, position data 326 may include coordinates, with respect to a coordinate framework of the artificial reality environment, of the speaker and the listener. In another example, position data 326 may include a relative position, such as a distance and direction, between the speaker and the listener in the artificial reality environment. FIGS. 5A-B illustrate exemplary artificial environments.

FIG. 5A illustrates speaker environment 510, corresponding to the speaker's artificial reality environment. Speaker environment 510 may include a speaker 512A, a listener avatar 522A, one or more walls 514, and one or more objects 516. Speaker environment 510 may represent the artificial reality environment that speaker 512A is experiencing, which may comprise a real-world environment, a virtual environment, or may be a combination of real and/or virtual environments.

In some embodiments, the term "avatar" may refer to a visible representation of a person. Avatars may take on various forms, including a human form, such as a replica of the corresponding person, or a character (which may not mirror the corresponding person) having human attributes.

Avatars may also take on non-human forms, such as animals and objects. Examples of avatars include, without limitation, digital representations (e.g., electronic images generated and manipulated by computing machines, holograms, etc.), virtual representations (e.g., characters in artificial-reality environments), and/or physical objects (e.g., machines such as telephones, speakers, screens which may project or present aspects of the person, tokens, etc.).

Speaker 512A may correspond to a user currently speaking in the artificial reality environment. Listener avatar 522A may correspond to a user who is not currently speaking in the artificial reality environment and therefore listening to speaker 512A. As different users speak and/or listen, the speaker/listener roles may change. In addition, there may be more users in the artificial reality environment who may take on speaker and/or listener roles. For the sake of simplicity, FIGS. 5A-B illustrate an example having one speaker and one listener.

Speaker environment 510 may include walls 514, which may be real walls of a real-world environment in which speaker 512A may be speaking. In some examples, one or more walls 514 may be virtual walls established during the artificial reality session. Speaker environment 510 may include objects 516 which may be real or virtual objects.

Listener avatar 522A may be a virtual representation in speaker environment 510. Listener avatar 522A, as presented in speaker environment 510, may mimic actions of the listener (e.g., listener 522B in FIG. 5B) such that speaker 512A may see and virtually interact with listener avatar 522A.

FIG. 5B illustrates listener environment 520, corresponding to the listener's artificial reality environment. Listener environment 520 may include listener 522B, a speaker avatar 512B, one or more walls 524, and one or more objects 526. FIG. 5B further illustrates direct sound path 532, indirect sound path 534, and relative position 530. Similar to speaker environment 510, listener environment 520 may represent the artificial reality environment that listener 522B is experiencing, which may comprise a real-world environment, a virtual environment, or may be a combination of real and/or virtual environments. For instance, walls 524 and/or objects 526 may be real objects that is in a real-world environment of listener 522B.

In listener environment 520, speaker avatar 512B may be a virtual presentation. Speaker avatar 512B may mimic actions and speech of the speaker (e.g., speaker 512A in FIG. 5A). Relative position 530, which may correspond to position data 326, illustrates a locational relationship between speaker avatar 512B and listener 522B. This locational relationship may be consistent between listener environment 520 and speaker environment 510 to maintain a consistent artificial reality experience for listener 522B and speaker 512A. However, in other examples, speaker environment 510 may present a different locational relationship. For instance, real-world physical constraints may prevent the same locational relationship from being presented in speaker environment 510. In such examples, relative position 530 may be determined with respect to listener environment 520. As will be explained further below, speaker 512A's speech may be directivity-attuned for listener environment 520 for listener 522B.

Turning back to FIG. 1, at step 140 one or more of the systems described herein may process, based on the pose and the relative position of the speaker within the artificial reality environment, the voice input to create a directivity-attuned voice signal for the listener. For example, processing module 310 may process voice input 322, using pose data 324 and position data 326, to create directivity-attuned voice signal 350.

In some embodiments, the term "directivity-attuned" may refer to a sound signal that may be processed to incorporate reverberations and other sound artifacts simulating directivity-based sound propagation in an artificial-reality environment.

The systems described herein may perform step 140 in a variety of ways. In one example, processing module 310, as part of computing device 402, may use position data 326 and pose data 324 to calculate sound paths from the speaker to the listener in the artificial reality environment. FIG. 5B illustrates example sound paths.

FIG. 5B shows direct sound path 532, corresponding to sound paths traveling directly from speaker avatar 512B to listener 522B based on relative position 530. Direct sound path 532 may represent sound traveling through the air without interference or reflections. Indirect sound path 534 may represent sound paths that have been reflected off surfaces, such as walls 524 and objects 526. In addition, certain surfaces may reflect sound differently than other surfaces. Shapes, materials, and locations of surfaces may affect sound propagation. For instance, a soft surface, such as a couch, may absorb and muffle sound, whereas a hard surface may reflect more sound to create an echo. Curves in the surfaces may also affect sound paths. Although in FIG. 5 indirect sound path 534 is illustrated with one reflection, indirect sound path 534 may involve many more reflections before reaching listener 522B.

Processing module 310, using sensor 470, may detect real-world aspects of listener environment 520. Processing module 310 may detect walls 524 and objects 526 as well as acoustic characteristics thereof. For instance, processing module 310 may recognize, based on a surface color pattern or otherwise recognizing a material, the acoustic characteristics. Processing module 310 may also identify acoustic characteristics of virtual objects in listener environment 520. Using the identified acoustic characteristics, processing module 310 may identify a reverberant property of the artificial reality environment of the listener and add, to voice input 322, reverberation based on the reverberant property of the listener's artificial reality environment to create directivity-attuned voice signal 350. Processing module 310 may identify the reverberant property and the reverberation by simulating sound energy traveling along direct sound path 532 and indirect sound path 534.

Because voice input 322 was captured from the speaker's environment (e.g., speaker environment 510), voice input 322 may exhibit reverberations from the speaker's environment. These reverberations may not necessarily be present if the speaker were speaking in the listener's environment. Processing module 310, using sensor 470, may recognize acoustic characteristics, based for instance on surface properties, of speaker environment 510. Processing module 310 may identify, in voice input 322, reverberation from the real-world environment of the speaker. For example, in speaker environment 510, speaker 512A's proximity to wall 514 may create an echo effect captured in voice input 322. Processing module 310 may determine sound paths in speaker environment 510 to identify these reverberations. Once identified, processing module 310 may remove at least a portion of the reverberation from voice input 322 to create directivity-attuned voice signal 350.

Direct sound path 532 and indirect sound path 534 may incorporate a pose of speaker 512A (e.g., pose data 324) for simulating sound propagation. For example, processing module 310 may apply a directivity pattern, such as directivity pattern 220, by orienting the directivity pattern based on the pose and calculating sound propagation. As the pose changes, the directivity pattern may be accordingly transposed. Additionally, direct sound path 532 and indirect sound path 534 may incorporate a pose of listener 522B (e.g., pose data 324). For instance, the pose of listener 522B, including ear orientation, may affect how direct sound path 532 and indirect sound path 534 reach listener 522B.

However, as alluded to above, human speech may exhibit dynamic changes to the directivity pattern such that a single directivity pattern may not sufficiently reproduce speech directivity. Various factors, such as physical characteristics of the speaker (e.g., the speaker's voice, age, gender, head size, etc.), physical characteristics of the speaker's room (e.g., distance to walls and objects, acoustic characteristics of the walls and objects, ambient sound, etc.) may affect directivity patterns. In addition, certain other factors, such as words spoken, tone, voice inflections, etc., may dynamically affect the directivity patterns while the speaker speaks. To account for such factors that may affect directivity patterns, processing module 310 may determine a directivity profile for the speaker. The directivity profile may describe or otherwise encapsulate the speaker's characteristics that may affect directivity. For example, the directivity profile may include speaker classifications that may be defined based on characteristics that exhibit a common directivity pattern. In other examples, the directivity profile may include the common directivity pattern and/or possible transformations for recreating the common directivity pattern from a generic directivity pattern. Processing module 310 may use the directivity profile to create directivity-attuned voice signal 350.

Processing module 310 may use various signals or factors for determining an appropriate directivity profile. For instance, processing module 310 may determine the directivity profile based on a content of voice input 322. Processing module may use speech recognition to identify words from voice input 322. FIG. 6A depicts a table 601 of directivity classifications based on words. As seen in FIG. 6, each word may be associated with a different directivity classification. The mouth and tongue positions and movements when pronouncing words may affect directivity. Thus, words that sound alike, such as "look," "book," and "took," may each be associated with different directivity patterns. Accordingly, the directivity profile for voice input 322 may include multiple directivity patterns, one for each word. Processing module 310 may apply, for each word of voice input 322, the corresponding directivity pattern to create directivity-attuned voice signal 350. Although FIG. 6 depicts directivity classification based on words, in other examples voice input 322 may be divided into different granular units, such as frame, word, syllable, phoneme, etc. Moreover, directivity classification may differ based on language, dialect, etc.

Processing module 310 may also determine the directivity profile based on characteristics and/or traits of the speaker. Examples of speaker characteristics may include, without limitation, a physical characteristic of the speaker, a voice frequency range of the speaker, a headset size of the speaker, and a gender of the speaker.

The speaker's characteristics may be determined from various sources. The speaker may opt in to providing certain characteristics, such as gender, headset size, etc., as part of the speaker's profile information. Other characteristics may be detected by sensor 470, such as voice frequency range. Alternatively, certain characteristics, such as voice frequency range, may be detected from voice input 322.

FIG. 6B illustrates a table 602 of directivity classifications based on speaker characteristics. For example, a male baritone may exhibit a different directivity pattern than a female alto. By applying these directivity classifications, processing module 310 may create directivity-attuned voice signal 350 which may account for the speaker's characteristics.

FIG. 6B depicts table 602 having predetermined directivity patterns for each specific combination of traits. Tables 601 and 602 may be simplified in that in some other implementations, the directivity classification table may include directivity patterns for many combined factors (e.g., "male," "baritone," "look"). In yet other implementations, each characteristic may instead be associated with a transformation to generic base directivity patterns, such that each characteristic may cumulatively transform the directivity patterns.

The directivity classifications of tables 601 and 602 may be derived empirically. For instance, the speaker may be recorded, using multiple microphones placed around the speaker, in different poses and speaking a representative sample of words to create a directivity profile specific to the speaker. However, as recording every user's directivity may not be feasible, a representative sample of people, exhibiting various characteristics, may be recorded and aggregated to determine representative directivity profiles based on the characteristics or other subgroups of people.

Although the directivity profile may be selected to match the speaker's characteristics, in other implementations the directivity profile may be selected to simulate different characteristics. For instance, if the speaker's avatar does not resemble the speaker physically, the directivity profile may be selected to conform with the avatar's characteristics. In such implementations, voice input 322 may be further processed to change a voice (e.g., to conform with the avatar) such that directivity-attuned voice signal 350 may not resemble voice input 322.

Returning now to FIG. 1, at step 150 one or more of the systems described herein may deliver the directivity-attuned voice signal to an artificial reality device of the listener. For example, delivering module 312 may deliver directivity-attuned voice signal 350 to the listener's artificial reality device.

The systems described herein may perform step 150 in a variety of ways. In one example, delivering module 312, as part of server 406, may deliver directivity-attuned voice signal 350 to computing device 402 of the listener. For instance, delivering module 312 may deliver directivity-attuned voice signal 350 binaurally to speaker 482. In some implementations, computing device 402 may further process directivity-attuned voice signal 350. For instance, computing device 402 may process directivity-attuned voice signal 350 to improve a sound output quality from speaker 482.

In some examples, computing device 402 may be an artificial reality device (e.g., augmented-reality system 700, augmented-reality system 800, and/or virtual-reality system 900) that outputs directivity-attuned voice signal 350 via speaker 482 (e.g., output audio transducers 708(A) and 708(B), acoustic transducers 820(A) and 820(B), and/or output audio transducers 906(A) and 906(B), respectively).

In some examples, computing device 402 may be part of and/or connected to a teleconferencing system, such as internet telephone conferencing, videoconferencing, web conferencing, etc. In yet other examples, computing device 402 may be part of and/or connected to a social networking system.

Although method 100 is described with respect to a single speaker and a single listener, method 100 or portions thereof, such as steps 130-150, may be repeated for each listener when there are multiple listeners. For example, a speaker may be speaking to two listeners in an artificial reality environment. Because the listeners may be positioned differently with respect to the speaker, separate directivity-attuned signals may be provided to each listener. However, when processing the separate directivity-attuned signals, certain information, such as the speaker's directivity profile, may be reused.

Conventional telepresence systems may not adequately capture and reproduce directivity changes exhibited by talking persons. The subtle audio cues or fluctuations resulting from dynamic speech directivity may add to the realism of the telepresence system. Capturing directivity may require an array of measurement points (e.g., 100) sampled on an imaginary sphere around a speaker's head and torso. However, because conventional artificial reality headsets lack such a microphone arrangement, the uncaptured dynamic speech directivity may need to be simulated.

The telepresence systems and methods herein may establish a directivity database characterizing different types of talkers for a broad array of speech content. The telepresence system may capture a talker's speech as well as pose, using the talker's headset. The telepresence system may then select, from the directivity database, an appropriate directivity profile for the speech content, talker's pose, and talker type, and incorporated into a sound propagation synthesis engine. The sound propagation synthesis engine may calculate direct and reflected sound paths from the virtual talker to the listener, considering the strength of the excitation signal of sound in every direction based on the selected directivity. The directivity may be updated with every word, syllable, etc. The telepresence system may deliver the virtual talker's propagated sound to the listener binaurally via the listener's headset. The telepresence system may deliver the virtual talker's propagated sound fast enough (e.g., under about 300-400 ms) to the listener so as not to cause a noticeable delay in conversing.

EXAMPLE EMBODIMENTS

Example 1. A computer-implemented method for reproducing dynamic speech directivity may include: capturing, via a headset microphone of a speaker's artificial reality device, voice input of a speaker in communication with a listener in an artificial reality environment; detecting a pose of the speaker within the artificial reality environment; determining a position of the speaker relative to a position of the listener within the artificial reality environment; processing, based on the pose and the relative position of the speaker within the artificial reality environment, the voice input to create a directivity-attuned voice signal for the listener; and delivering the directivity-attuned voice signal to an artificial reality device of the listener.

Example 2. The method of Example 1, further comprising determining a directivity profile for the speaker, wherein creating the directivity-attuned voice signal further comprises using the directivity profile to create the directivity-attuned voice signal for the listener.

Example 3. The method of any of Examples 1-2, wherein the directivity profile is determined based on a content of the voice input such that the directivity-attuned voice signal is created in a manner that accounts for the content of the voice input.

Example 4. The method of any of Examples 1-3, wherein the directivity profile is determined based on at least one of a physical characteristic of the speaker, a voice frequency range of the speaker, or a headset size of the speaker such that the directivity-attuned voice signal is created in a manner that accounts for the physical characteristic of the speaker, the voice frequency range of the speaker, or the headset size of the speaker.

Example 5. The method of any of Examples 1-4, wherein the directivity profile is determined based on a gender of the speaker such that the directivity-attuned voice signal is created in a manner that accounts for the gender of the speaker.

Example 6. The method of any of Examples 1-5, wherein creating the directivity-attuned voice signal further comprises: identifying, in the voice input, reverberation from a real-world environment of the speaker; and removing, from the voice input, at least a portion of the reverberation.

Example 7. The method of any of Examples 1-6, wherein creating the directivity-attuned voice signal further comprises: identifying a reverberant property of an artificial reality environment of the listener; and adding, to the voice input, reverberation based on the reverberant property of the artificial reality environment of the listener.

Example 8. A system for reproducing dynamic speech directivity may include: at least one physical processor; physical memory comprising computer-executable instructions that, when executed by the physical processor, cause the physical processor to: capture, via a headset microphone of a speaker's artificial reality device, voice input of a speaker in communication with a listener in an artificial reality environment; detect a pose of the speaker within the artificial reality environment; determine a position of the speaker relative to a position of the listener within the artificial reality environment; process, based on the pose and the relative position of the speaker within the artificial reality environment, the voice input to create a directivity-attuned voice signal for the listener; and deliver the directivity-attuned voice signal to an artificial reality device of the listener.

Example 9. The system of Example 8, wherein the instructions further comprise instructions for determining a directivity profile for the speaker, wherein creating the directivity-attuned voice signal further comprises using the directivity profile to create the directivity-attuned voice signal for the listener.

Example 10. The system of any of Examples 8-9, wherein the directivity profile is determined based on a content of the voice input such that the directivity-attuned voice signal is created in a manner that accounts for the content of the voice input.

Example 11. The system of any of Examples 8-10, wherein the directivity profile is determined based on at least one of a physical characteristic of the speaker, a voice frequency range of the speaker, or a headset size of the speaker such that the directivity-attuned voice signal is created in a manner that accounts for the physical characteristic of the speaker, the voice frequency range of the speaker, or the headset size of the speaker.

Example 12. The system of any of Examples 8-11, wherein the directivity profile is determined based on a gender of the speaker such that the directivity-attuned voice signal is created in a manner that accounts for the gender of the speaker.

Example 13. The system of any of Examples 8-12, wherein creating the directivity-attuned voice signal further comprises: identifying, in the voice input, reverberation from a real-world environment of the speaker; and removing, from the voice input, at least a portion of the reverberation.

Example 14. The system of any of Examples 8-13, wherein creating the directivity-attuned voice signal further comprises: identifying a reverberant property of an artificial reality environment of the listener; and adding, to the voice input, reverberation based on the reverberant property of the artificial reality environment of the listener.

Example 15. A non-transitory computer-readable medium may include one or more computer-executable instructions that, when executed by at least one processor of a computing device, may cause the computing device to: capture, via a headset microphone of a speaker's artificial reality device, voice input of a speaker in communication with a listener in an artificial reality environment; detect a pose of the speaker within the artificial reality environment; determine a position of the speaker relative to a position of the listener within the artificial reality environment; process, based on the pose and the relative position of the speaker within the artificial reality environment, the voice input to create a directivity-attuned voice signal for the listener; and deliver the directivity-attuned voice signal to an artificial reality device of the listener.

Example 16. The computer-readable medium of Example 15, wherein the instructions further comprise instructions for determining a directivity profile for the speaker, wherein creating the directivity-attuned voice signal further comprises using the directivity profile to create the directivity-attuned voice signal for the listener.

Example 17. The computer-readable medium of any of Examples 15-16, wherein the directivity profile is determined based on a content of the voice input such that the directivity-attuned voice signal is created in a manner that accounts for the content of the voice input.

Example 18. The computer-readable medium of any of Examples 15-17, wherein the directivity profile is determined based on at least one of a gender of the speaker, a physical characteristic of the speaker, a voice frequency range of the speaker, or a headset size of the speaker such that the directivity-attuned voice signal is created in a manner that accounts for the gender of the speaker, the physical characteristic of the speaker, the voice frequency range of the speaker, or the headset size of the speaker.

Example 19. The computer-readable medium of any of Examples 15-18, wherein creating the directivity-attuned voice signal further comprises: identifying, in the voice input, reverberation from a real-world environment of the speaker; and removing, from the voice input, at least a portion of the reverberation.

Example 20. The computer-readable medium of any of Examples 15-19, wherein creating the directivity-attuned voice signal further comprises: identifying a reverberant property of an artificial reality environment of the listener; and adding, to the voice input, reverberation based on the reverberant property of the artificial reality environment of the listener.

Embodiments of the present disclosure may include or be implemented in conjunction with various types of artificial-reality systems. Artificial reality is a form of reality that has been adjusted in some manner before presentation to a user, which may include, for example, a virtual reality, an augmented reality, a mixed reality, a hybrid reality, or some combination and/or derivative thereof. Artificial-reality content may include completely computer-generated content or computer-generated content combined with captured (e.g., real-world) content. The artificial-reality content may include video, audio, haptic feedback, or some combination thereof, any of which may be presented in a single channel or in multiple channels (such as stereo video that produces a three-dimensional (3D) effect to the viewer). Additionally, in some embodiments, artificial reality may also be associated with applications, products, accessories, services, or some combination thereof, that are used to, for example, create content in an artificial reality and/or are otherwise used in (e.g., to perform activities in) an artificial reality.

Artificial-reality systems may be implemented in a variety of different form factors and configurations. Some artificial-reality systems may be designed to work without near-eye displays (NEDs), an example of which is augmented-reality system 700 in FIG. 7. Other artificial-reality systems may include an NED that also provides visibility into the real world (e.g., augmented-reality system 800 in FIG. 8) or that visually immerses a user in an artificial reality (e.g., virtual-reality system 900 in FIG. 9). While some artificial-reality devices may be self-contained systems, other artificial-reality devices may communicate and/or coordinate with external devices to provide an artificial-reality experience to a user. Examples of such external devices include handheld controllers, mobile devices, desktop computers, devices worn by a user, devices worn by one or more other users, and/or any other suitable external system.

Turning to FIG. 7, augmented-reality system 700 generally represents a wearable device dimensioned to fit about a body part (e.g., a head) of a user. As shown in FIG. 7, system 700 may include a frame 702 and a camera assembly 704 that is coupled to frame 702 and configured to gather information about a local environment by observing the local environment. Augmented-reality system 700 may also include one or more audio devices, such as output audio transducers 708(A) and 708(B) and input audio transducers 710. Output audio transducers 708(A) and 708(B) may provide audio feedback and/or content to a user, and input audio transducers 710 may capture audio in a user's environment.

As shown, augmented-reality system 700 may not necessarily include an NED positioned in front of a user's eyes. Augmented-reality systems without NEDs may take a variety of forms, such as head bands, hats, hair bands, belts, watches, wrist bands, ankle bands, rings, neckbands, necklaces, chest bands, eyewear frames, and/or any other suitable type or form of apparatus. While augmented-reality system 700 may not include an NED, augmented-reality system 700 may include other types of screens or visual feedback devices (e.g., a display screen integrated into a side of frame 702).

The embodiments discussed in this disclosure may also be implemented in augmented-reality systems that include one or more NEDs. For example, as shown in FIG. 8, augmented-reality system 800 may include an eyewear device 802 with a frame 810 configured to hold a left display device 815(A) and a right display device 815(B) in front of a user's eyes. Display devices 815(A) and 815(B) may act together or independently to present an image or series of images to a user. While augmented-reality system 800 includes two displays, embodiments of this disclosure may be implemented in augmented-reality systems with a single NED or more than two NEDs.

In some embodiments, augmented-reality system 800 may include one or more sensors, such as sensor 840. Sensor 840 may generate measurement signals in response to motion of augmented-reality system 800 and may be located on substantially any portion of frame 810. Sensor 840 may represent a position sensor, an inertial measurement unit (IMU), a depth camera assembly, or any combination thereof. In some embodiments, augmented-reality system 800 may or may not include sensor 840 or may include more than one sensor. In embodiments in which sensor 840 includes an IMU, the IMU may generate calibration data based on measurement signals from sensor 840. Examples of sensor 840 may include, without limitation, accelerometers, gyroscopes, magnetometers, other suitable types of sensors that detect motion, sensors used for error correction of the IMU, or some combination thereof. Augmented-reality system 800 may also include a microphone array with a plurality of acoustic transducers 820(A)-820(J), referred to collectively as acoustic transducers 820. Acoustic transducers 820 may be transducers that detect air pressure variations induced by sound waves. Each acoustic transducer 820 may be configured to detect sound and convert the detected sound into an electronic format (e.g., an analog or digital format). The microphone array in FIG. 8 may include, for example, ten acoustic transducers: 820(A) and 820(B), which may be designed to be placed inside a corresponding ear of the user, acoustic transducers 820(C), 820(D), 820(E), 820(F), 820(G), and 820(H), which may be positioned at various locations on frame 810, and/or acoustic transducers 820(1) and 820(J), which may be positioned on a corresponding neckband 805.

In some embodiments, one or more of acoustic transducers 820(A)-(F) may be used as output transducers (e.g., speakers). For example, acoustic transducers 820(A) and/or 820(B) may be earbuds or any other suitable type of headphone or speaker.

The configuration of acoustic transducers 820 of the microphone array may vary. While augmented-reality system 800 is shown in FIG. 8 as having ten acoustic transducers 820, the number of acoustic transducers 820 may be greater or less than ten. In some embodiments, using higher numbers of acoustic transducers 820 may increase the amount of audio information collected and/or the sensitivity and accuracy of the audio information. In contrast, using a lower number of acoustic transducers 820 may decrease the computing power required by an associated controller 850 to process the collected audio information. In addition, the position of each acoustic transducer 820 of the microphone array may vary. For example, the position of an acoustic transducer 820 may include a defined position on the user, a defined coordinate on frame 810, an orientation associated with each acoustic transducer 820, or some combination thereof.

Acoustic transducers 820(A) and 820(B) may be positioned on different parts of the user's ear, such as behind the pinna or within the auricle or fossa. Or, there may be additional acoustic transducers 820 on or surrounding the ear in addition to acoustic transducers 820 inside the ear canal. Having an acoustic transducer 820 positioned next to an ear canal of a user may enable the microphone array to collect information on how sounds arrive at the ear canal. By positioning at least two of acoustic transducers 820 on either side of a user's head (e.g., as binaural microphones), augmented-reality device 800 may simulate binaural hearing and capture a 3D stereo sound field around about a user's head. In some embodiments, acoustic transducers 820(A) and 820(B) may be connected to augmented-reality system 800 via a wired connection 830, and in other embodiments, acoustic transducers 820(A) and 820(B) may be connected to augmented-reality system 800 via a wireless connection (e.g., a Bluetooth connection). In still other embodiments, acoustic transducers 820(A) and 820(B) may not be used at all in conjunction with augmented-reality system 800.

Acoustic transducers 820 on frame 810 may be positioned along the length of the temples, across the bridge, above or below display devices 815(A) and 815(B), or some combination thereof. Acoustic transducers 820 may be oriented such that the microphone array is able to detect sounds in a wide range of directions surrounding the user wearing the augmented-reality system 800. In some embodiments, an optimization process may be performed during manufacturing of augmented-reality system 800 to determine relative positioning of each acoustic transducer 820 in the microphone array.

In some examples, augmented-reality system 800 may include or be connected to an external device (e.g., a paired device), such as neckband 805. Neckband 805 generally represents any type or form of paired device. Thus, the following discussion of neckband 805 may also apply to various other paired devices, such as charging cases, smart watches, smart phones, wrist bands, other wearable devices, hand-held controllers, tablet computers, laptop computers and other external compute devices, etc.

As shown, neckband 805 may be coupled to eyewear device 802 via one or more connectors. The connectors may be wired or wireless and may include electrical and/or non-electrical (e.g., structural) components. In some cases, eyewear device 802 and neckband 805 may operate independently without any wired or wireless connection between them. While FIG. 8 illustrates the components of eyewear device 802 and neckband 805 in example locations on eyewear device 802 and neckband 805, the components may be located elsewhere and/or distributed differently on eyewear device 802 and/or neckband 805. In some embodiments, the components of eyewear device 802 and neckband 805 may be located on one or more additional peripheral devices paired with eyewear device 802, neckband 805, or some combination thereof.

Pairing external devices, such as neckband 805, with augmented-reality eyewear devices may enable the eyewear devices to achieve the form factor of a pair of glasses while still providing sufficient battery and computation power for expanded capabilities. Some or all of the battery power, computational resources, and/or additional features of augmented-reality system 800 may be provided by a paired device or shared between a paired device and an eyewear device, thus reducing the weight, heat profile, and form factor of the eyewear device overall while still retaining desired functionality. For example, neckband 805 may allow components that would otherwise be included on an eyewear device to be included in neckband 805 since users may tolerate a heavier weight load on their shoulders than they would tolerate on their heads. Neckband 805 may also have a larger surface area over which to diffuse and disperse heat to the ambient environment. Thus, neckband 805 may allow for greater battery and computation capacity than might otherwise have been possible on a stand-alone eyewear device. Since weight carried in neckband 805 may be less invasive to a user than weight carried in eyewear device 802, a user may tolerate wearing a lighter eyewear device and carrying or wearing the paired device for greater lengths of time than a user would tolerate wearing a heavy standalone eyewear device, thereby enabling users to more fully incorporate artificial-reality environments into their day-to-day activities.

Neckband 805 may be communicatively coupled with eyewear device 802 and/or to other devices. These other devices may provide certain functions (e.g., tracking, localizing, depth mapping, processing, storage, etc.) to augmented-reality system 800. In the embodiment of FIG. 8, neckband 805 may include two acoustic transducers (e.g., 820(1) and 820(J)) that are part of the microphone array (or potentially form their own microphone subarray). Neckband 805 may also include a controller 825 and a power source 835.

Acoustic transducers 820(1) and 820(J) of neckband 805 may be configured to detect sound and convert the detected sound into an electronic format (analog or digital). In the embodiment of FIG. 8, acoustic transducers 820(1) and 820(J) may be positioned on neckband 805, thereby increasing the distance between the neckband acoustic transducers 820(1) and 820(J) and other acoustic transducers 820 positioned on eyewear device 802. In some cases, increasing the distance between acoustic transducers 820 of the microphone array may improve the accuracy of beamforming performed via the microphone array. For example, if a sound is detected by acoustic transducers 820(C) and 820(D) and the distance between acoustic transducers 820(C) and 820(D) is greater than, e.g., the distance between acoustic transducers 820(D) and 820(E), the determined source location of the detected sound may be more accurate than if the sound had been detected by acoustic transducers 820(D) and 820(E).

Controller 825 of neckband 805 may process information generated by the sensors on neckband 805 and/or augmented-reality system 800. For example, controller 825 may process information from the microphone array that describes sounds detected by the microphone array. For each detected sound, controller 825 may perform a direction-of-arrival (DOA) estimation to estimate a direction from which the detected sound arrived at the microphone array. As the microphone array detects sounds, controller 825 may populate an audio data set with the information. In embodiments in which augmented-reality system 800 includes an inertial measurement unit, controller 825 may compute all inertial and spatial calculations from the IMU located on eyewear device 802. A connector may convey information between augmented-reality system 800 and neckband 805 and between augmented-reality system 800 and controller 825. The information may be in the form of optical data, electrical data, wireless data, or any other transmittable data form. Moving the processing of information generated by augmented-reality system 800 to neckband 805 may reduce weight and heat in eyewear device 802, making it more comfortable to the user.

Power source 835 in neckband 805 may provide power to eyewear device 802 and/or to neckband 805. Power source 835 may include, without limitation, lithium ion batteries, lithium-polymer batteries, primary lithium batteries, alkaline batteries, or any other form of power storage. In some cases, power source 835 may be a wired power source. Including power source 835 on neckband 805 instead of on eyewear device 802 may help better distribute the weight and heat generated by power source 835.

As noted, some artificial-reality systems may, instead of blending an artificial reality with actual reality, substantially replace one or more of a user's sensory perceptions of the real world with a virtual experience. One example of this type of system is a head-worn display system, such as virtual-reality system 900 in FIG. 9, that mostly or completely covers a user's field of view. Virtual-reality system 900 may include a front rigid body 902 and a band 904 shaped to fit around a user's head. Virtual-reality system 900 may also include output audio transducers 906(A) and 906(B). Furthermore, while not shown in FIG. 9, front rigid body 902 may include one or more electronic elements, including one or more electronic displays, one or more inertial measurement units (IMUS), one or more tracking emitters or detectors, and/or any other suitable device or system for creating an artificial reality experience.

Artificial-reality systems may include a variety of types of visual feedback mechanisms. For example, display devices in augmented-reality system 800 and/or virtual-reality system 900 may include one or more liquid crystal displays (LCDs), light emitting diode (LED) displays, organic LED (OLED) displays digital light project (DLP) micro-displays, liquid crystal on silicon (LCoS) micro-displays, and/or any other suitable type of display screen. Artificial-reality systems may include a single display screen for both eyes or may provide a display screen for each eye, which may allow for additional flexibility for varifocal adjustments or for correcting a user's refractive error. Some artificial-reality systems may also include optical subsystems having one or more lenses (e.g., conventional concave or convex lenses, Fresnel lenses, adjustable liquid lenses, etc.) through which a user may view a display screen. These optical subsystems may serve a variety of purposes, including to collimate (e.g., make an object appear at a greater distance than its physical distance), to magnify (e.g., make an object appear larger than its actual size), and/or to relay (to, e.g., the viewer's eyes) light. These optical subsystems may be used in a non-pupil-forming architecture (such as a single lens configuration that directly collimates light but results in so-called pincushion distortion) and/or a pupil-forming architecture (such as a multi-lens configuration that produces so-called barrel distortion to nullify pincushion distortion).

In addition to or instead of using display screens, some artificial-reality systems may include one or more projection systems. For example, display devices in augmented-reality system 800 and/or virtual-reality system 900 may include micro-LED projectors that project light (using, e.g., a waveguide) into display devices, such as clear combiner lenses that allow ambient light to pass through. The display devices may refract the projected light toward a user's pupil and may enable a user to simultaneously view both artificial-reality content and the real world. The display devices may accomplish this using any of a variety of different optical components, including waveguides components (e.g., holographic, planar, diffractive, polarized, and/or reflective waveguide elements), light-manipulation surfaces and elements (such as diffractive, reflective, and refractive elements and gratings), coupling elements, etc. Artificial-reality systems may also be configured with any other suitable type or form of image projection system, such as retinal projectors used in virtual retina displays.

Artificial-reality systems may also include various types of computer vision components and subsystems. For example, augmented-reality system 700, augmented-reality system 800, and/or virtual-reality system 900 may include one or more optical sensors, such as two-dimensional (2D) or 3D cameras, time-of-flight depth sensors, single-beam or sweeping laser rangefinders, 3D LiDAR sensors, and/or any other suitable type or form of optical sensor. An artificial-reality system may process data from one or more of these sensors to identify a location of a user, to map the real world, to provide a user with context about real-world surroundings, and/or to perform a variety of other functions.

Artificial-reality systems may also include one or more input and/or output audio transducers. In the examples shown in FIGS. 7 and 9, output audio transducers 708(A), 708(B), 906(A), and 906(B) may include voice coil speakers, ribbon speakers, electrostatic speakers, piezoelectric speakers, bone conduction transducers, cartilage conduction transducers, and/or any other suitable type or form of audio transducer. Similarly, input audio transducers 710 may include condenser microphones, dynamic microphones, ribbon microphones, and/or any other type or form of input transducer. In some embodiments, a single transducer may be used for both audio input and audio output.

While not shown in FIGS. 7-9, artificial-reality systems may include tactile (i.e., haptic) feedback systems, which may be incorporated into headwear, gloves, body suits, handheld controllers, environmental devices (e.g., chairs, floormats, etc.), and/or any other type of device or system. Haptic feedback systems may provide various types of cutaneous feedback, including vibration, force, traction, texture, and/or temperature. Haptic feedback systems may also provide various types of kinesthetic feedback, such as motion and compliance. Haptic feedback may be implemented using motors, piezoelectric actuators, fluidic systems, and/or a variety of other types of feedback mechanisms. Haptic feedback systems may be implemented independent of other artificial-reality devices, within other artificial-reality devices, and/or in conjunction with other artificial-reality devices.

By providing haptic sensations, audible content, and/or visual content, artificial-reality systems may create an entire virtual experience or enhance a user's real-world experience in a variety of contexts and environments. For instance, artificial-reality systems may assist or extend a user's perception, memory, or cognition within a particular environment. Some systems may enhance a user's interactions with other people in the real world or may enable more immersive interactions with other people in a virtual world. Artificial-reality systems may also be used for educational purposes (e.g., for teaching or training in schools, hospitals, government organizations, military organizations, business enterprises, etc.), entertainment purposes (e.g., for playing video games, listening to music, watching video content, etc.), and/or for accessibility purposes (e.g., as hearing aids, visuals aids, etc.). The embodiments disclosed herein may enable or enhance a user's artificial-reality experience in one or more of these contexts and environments and/or in other contexts and environments.

Some augmented-reality systems may map a user's and/or device's environment using techniques referred to as "simultaneous location and mapping" (SLAM). SLAM mapping and location identifying techniques may involve a variety of hardware and software tools that can create or update a map of an environment while simultaneously keeping track of a user's location within the mapped environment. SLAM may use many different types of sensors to create a map and determine a user's position within the map.

SLAM techniques may, for example, implement optical sensors to determine a user's location. Radios including WiFi, Bluetooth, global positioning system (GPS), cellular or other communication devices may be also used to determine a user's location relative to a radio transceiver or group of transceivers (e.g., a WiFi router or group of GPS satellites). Acoustic sensors such as microphone arrays or 2D or 3D sonar sensors may also be used to determine a user's location within an environment. Augmented-reality and virtual-reality devices (such as systems 700, 800, and 900 of FIGS. 7-9, respectively) may incorporate any or all of these types of sensors to perform SLAM operations such as creating and continually updating maps of the user's current environment. In at least some of the embodiments described herein, SLAM data generated by these sensors may be referred to as "environmental data" and may indicate a user's current environment. This data may be stored in a local or remote data store (e.g., a cloud data store) and may be provided to a user's AR/VR device on demand.

When the user is wearing an augmented-reality headset or virtual-reality headset in a given environment, the user may be interacting with other users or other electronic devices that serve as audio sources. In some cases, it may be desirable to determine where the audio sources are located relative to the user and then present the audio sources to the user as if they were coming from the location of the audio source. The process of determining where the audio sources are located relative to the user may be referred to as "localization," and the process of rendering playback of the audio source signal to appear as if it is coming from a specific direction may be referred to as "spatialization."

Localizing an audio source may be performed in a variety of different ways. In some cases, an augmented-reality or virtual-reality headset may initiate a DOA analysis to determine the location of a sound source. The DOA analysis may include analyzing the intensity, spectra, and/or arrival time of each sound at the artificial-reality device to determine the direction from which the sounds originated. The DOA analysis may include any suitable algorithm for analyzing the surrounding acoustic environment in which the artificial-reality device is located.

For example, the DOA analysis may be designed to receive input signals from a microphone and apply digital signal processing algorithms to the input signals to estimate the direction of arrival. These algorithms may include, for example, delay and sum algorithms where the input signal is sampled, and the resulting weighted and delayed versions of the sampled signal are averaged together to determine a direction of arrival. A least mean squared (LMS) algorithm may also be implemented to create an adaptive filter. This adaptive filter may then be used to identify differences in signal intensity, for example, or differences in time of arrival. These differences may then be used to estimate the direction of arrival. In another embodiment, the DOA may be determined by converting the input signals into the frequency domain and selecting specific bins within the time-frequency (TF) domain to process. Each selected TF bin may be processed to determine whether that bin includes a portion of the audio spectrum with a direct-path audio signal. Those bins having a portion of the direct-path signal may then be analyzed to identify the angle at which a microphone array received the direct-path audio signal. The determined angle may then be used to identify the direction of arrival for the received input signal. Other algorithms not listed above may also be used alone or in combination with the above algorithms to determine DOA.

In some embodiments, different users may perceive the source of a sound as coming from slightly different locations. This may be the result of each user having a unique head-related transfer function (HRTF), which may be dictated by a user's anatomy including ear canal length and the positioning of the ear drum. The artificial-reality device may provide an alignment and orientation guide, which the user may follow to customize the sound signal presented to the user based on their unique HRTF. In some embodiments, an artificial-reality device may implement one or more microphones to listen to sounds within the user's environment. The augmented-reality or virtual-reality headset may use a variety of different array transfer functions (e.g., any of the DOA algorithms identified above) to estimate the direction of arrival for the sounds. Once the direction of arrival has been determined, the artificial-reality device may play back sounds to the user according to the user's unique HRTF. Accordingly, the DOA estimation generated using the array transfer function (ATF) may be used to determine the direction from which the sounds are to be played from. The playback sounds may be further refined based on how that specific user hears sounds according to the HRTF.

In addition to or as an alternative to performing a DOA estimation, an artificial-reality device may perform localization based on information received from other types of sensors. These sensors may include cameras, IR sensors, heat sensors, motion sensors, GPS receivers, or in some cases, sensors that detect a user's eye movements. For example, as noted above, an artificial-reality device may include an eye tracker or gaze detector that determines where the user is looking. Often, the user's eyes will look at the source of the sound, if only briefly. Such clues provided by the user's eyes may further aid in determining the location of a sound source. Other sensors such as cameras, heat sensors, and IR sensors may also indicate the location of a user, the location of an electronic device, or the location of another sound source. Any or all of the above methods may be used individually or in combination to determine the location of a sound source and may further be used to update the location of a sound source over time.

Some embodiments may implement the determined DOA to generate a more customized output audio signal for the user. For instance, an "acoustic transfer function" may characterize or define how a sound is received from a given location. More specifically, an acoustic transfer function may define the relationship between parameters of a sound at its source location and the parameters by which the sound signal is detected (e.g., detected by a microphone array or detected by a user's ear). An artificial-reality device may include one or more acoustic sensors that detect sounds within range of the device. A controller of the artificial-reality device may estimate a DOA for the detected sounds (using, e.g., any of the methods identified above) and, based on the parameters of the detected sounds, may generate an acoustic transfer function that is specific to the location of the device. This customized acoustic transfer function may thus be used to generate a spatialized output audio signal where the sound is perceived as coming from a specific location.

Indeed, once the location of the sound source or sources is known, the artificial-reality device may re-render (i.e., spatialize) the sound signals to sound as if coming from the direction of that sound source. The artificial-reality device may apply filters or other digital signal processing that alter the intensity, spectra, or arrival time of the sound signal. The digital signal processing may be applied in such a way that the sound signal is perceived as originating from the determined location. The artificial-reality device may amplify or subdue certain frequencies or change the time that the signal arrives at each ear. In some cases, the artificial-reality device may create an acoustic transfer function that is specific to the location of the device and the detected direction of arrival of the sound signal. In some embodiments, the artificial-reality device may re-render the source signal in a stereo device or multi-speaker device (e.g., a surround sound device). In such cases, separate and distinct audio signals may be sent to each speaker. Each of these audio signals may be altered according to the user's HRTF and according to measurements of the user's location and the location of the sound source to sound as if they are coming from the determined location of the sound source. Accordingly, in this manner, the artificial-reality device (or speakers associated with the device) may re-render an audio signal to sound as if originating from a specific location.

As detailed above, the computing devices and systems described and/or illustrated herein broadly represent any type or form of computing device or system capable of executing computer-readable instructions, such as those contained within the modules described herein. In their most basic configuration, these computing device(s) may each include at least one memory device and at least one physical processor.

In some examples, the term "memory device" generally refers to any type or form of volatile or non-volatile storage device or medium capable of storing data and/or computer-readable instructions. In one example, a memory device may store, load, and/or maintain one or more of the modules described herein. Examples of memory devices include, without limitation, Random Access Memory (RAM), Read Only Memory (ROM), flash memory, Hard Disk Drives (HDDs), Solid-State Drives (SSDs), optical disk drives, caches, variations or combinations of one or more of the same, or any other suitable storage memory.

In some examples, the term "physical processor" generally refers to any type or form of hardware-implemented processing unit capable of interpreting and/or executing computer-readable instructions. In one example, a physical processor may access and/or modify one or more modules stored in the above-described memory device. Examples of physical processors include, without limitation, microprocessors, microcontrollers, Central Processing Units (CPUs), Field-Programmable Gate Arrays (FPGAs) that implement softcore processors, Application-Specific Integrated Circuits (ASICs), portions of one or more of the same, variations or combinations of one or more of the same, or any other suitable physical processor.

Although illustrated as separate elements, the modules described and/or illustrated herein may represent portions of a single module or application. In addition, in certain embodiments one or more of these modules may represent one or more software applications or programs that, when executed by a computing device, may cause the computing device to perform one or more tasks. For example, one or more of the modules described and/or illustrated herein may represent modules stored and configured to run on one or more of the computing devices or systems described and/or illustrated herein. One or more of these modules may also represent all or portions of one or more special-purpose computers configured to perform one or more tasks.

In addition, one or more of the modules described herein may transform data, physical devices, and/or representations of physical devices from one form to another. For example, one or more of the modules recited herein may receive voice input data to be transformed, transform the voice input data, output a result of the transformation to provide a the voice input to a listener, use the result of the transformation to reproduce dynamic speech directivity, and store the result of the transformation delivery to users. Additionally or alternatively, one or more of the modules recited herein may transform a processor, volatile memory, non-volatile memory, and/or any other portion of a physical computing device from one form to another by executing on the computing device, storing data on the computing device, and/or otherwise interacting with the computing device.

In some embodiments, the term "computer-readable medium" generally refers to any form of device, carrier, or medium capable of storing or carrying computer-readable instructions. Examples of computer-readable media include, without limitation, transmission-type media, such as carrier waves, and non-transitory-type media, such as magnetic-storage media (e.g., hard disk drives, tape drives, and floppy disks), optical-storage media (e.g., Compact Disks (CDs), Digital Video Disks (DVDs), and BLU-RAY disks), electronic-storage media (e.g., solid-state drives and flash media), and other distribution systems.

The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

The preceding description has been provided to enable others skilled in the art to best utilize various aspects of the exemplary embodiments disclosed herein. This exemplary description is not intended to be exhaustive or to be limited to any precise form disclosed. Many modifications and variations are possible without departing from the spirit and scope of the present disclosure. The embodiments disclosed herein should be considered in all respects illustrative and not restrictive. Reference should be made to the appended claims and their equivalents in determining the scope of the present disclosure.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and have the same meaning as the word "comprising."

What is claimed is:

1. A method comprising:

capturing, via a headset microphone of a speaker's artificial reality device, voice input of a speaker in communication with a listener in an artificial reality environment;

detecting a pose of the speaker within the artificial reality environment;

determining a position of the speaker relative to a position of the listener within the artificial reality environment;

determining a directivity profile for the speaker;

determining a directivity pattern for the voice input based on the pose, the relative position of the speaker within the artificial reality environment, and the directivity profile;

processing, using the directivity pattern, the voice input to create a directivity-attuned voice signal for the listener; and delivering the directivity-attuned voice signal to an artificial reality device of the listener.

2. The method of claim 1, wherein the directivity profile is determined based on a content of the voice input such that the directivity-attuned voice signal is created in a manner that accounts for the content of the voice input.

3. The method of claim 1, wherein the directivity profile is determined based on at least one of a physical characteristic of the speaker, a voice frequency range of the speaker, or a headset size of the speaker such that the directivity-attuned voice signal is created in a manner that accounts for the physical characteristic of the speaker, the voice frequency range of the speaker, or the headset size of the speaker.

4. The method of claim 1, wherein the directivity profile is determined based on a gender of the speaker such that the directivity-attuned voice signal is created in a manner that accounts for the gender of the speaker.

5. The method of claim 1, wherein creating the directivity-attuned voice signal further comprises:

identifying, in the voice input, reverberation from a real-world environment of the speaker; and removing, from the voice input, at least a portion of the reverberation.

6. The method of claim 1, wherein creating the directivity-attuned voice signal further comprises:

identifying a reverberant property of an artificial reality environment of the listener; and adding, to the voice input, reverberation based on the reverberant property of the artificial reality environment of the listener.

7. A system comprising:

at least one physical processor;

physical memory comprising computer-executable instructions that, when executed by the physical processor, cause the physical processor to:

capture, via a headset microphone of a speaker's artificial reality device, voice input of a speaker in communication with a listener in an artificial reality environment;

detect a pose of the speaker within the artificial reality environment;

determine a position of the speaker relative to a position of the listener within the artificial reality environment;

determine a directivity profile for the speaker;

determine a directivity pattern for the voice input based on the pose, the relative position of the speaker within the artificial reality environment, and the directivity profile;

process, using the directivity pattern, the voice input to create a directivity-attuned voice signal for the listener; and deliver the directivity-attuned voice signal to an artificial reality device of the listener.

8. The system of claim 7, wherein the directivity profile is determined based on a content of the voice input such that the directivity-attuned voice signal is created in a manner that accounts for the content of the voice input.

9. The system of claim 7, wherein the directivity profile is determined based on at least one of a physical characteristic of the speaker, a voice frequency range of the speaker, or a headset size of the speaker such that the directivity-attuned voice signal is created in a manner that accounts for the physical characteristic of the speaker, the voice frequency range of the speaker, or the headset size of the speaker.

10. The system of claim 7, wherein the directivity profile is determined based on a gender of the speaker such that the directivity-attuned voice signal is created in a manner that accounts for the gender of the speaker.

11. The system of claim 7, wherein creating the directivity-attuned voice signal further comprises:

identifying, in the voice input, reverberation from a real-world environment of the speaker; and removing, from the voice input, at least a portion of the reverberation.

12. The system of claim 7, wherein creating the directivity-attuned voice signal further comprises:

identifying a reverberant property of an artificial reality environment of the listener; and adding, to the voice input, reverberation based on the reverberant property of the artificial reality environment of the listener.

13. A non-transitory computer-readable medium comprising one or more computer-executable instructions that, when executed by at least one processor of a computing device, cause the computing device to:

capture, via a headset microphone of a speaker's artificial reality device, voice input of a speaker in communication with a listener in an artificial reality environment;

detect a pose of the speaker within the artificial reality environment;

determine a position of the speaker relative to a position of the listener within the artificial reality environment;

determine a directivity profile for the speaker;

determine a directivity pattern for the voice input based on the pose, the relative position of the speaker within the artificial reality environment, and the directivity profile;

process, using the directivity pattern, the voice input to create a directivity-attuned voice signal for the listener; and deliver the directivity-attuned voice signal to an artificial reality device of the listener.

14. The computer-readable medium of claim 13, wherein the directivity profile is determined based on a content of the voice input such that the directivity-attuned voice signal is created in a manner that accounts for the content of the voice input.

15. The computer-readable medium of claim 13, wherein the directivity profile is determined based on at least one of a gender of the speaker, a physical characteristic of the speaker, a voice frequency range of the speaker, or a headset size of the speaker such that the directivity-attuned voice signal is created in a manner that accounts for the gender of the speaker, the physical characteristic of the speaker, the voice frequency range of the speaker, or the headset size of the speaker.

16. The computer-readable medium of claim 13, wherein creating the directivity-attuned voice signal further comprises:

identifying, in the voice input, reverberation from a real-world environment of the speaker; and removing, from the voice input, at least a portion of the reverberation.

17. The computer-readable medium of claim 13, wherein creating the directivity-attuned voice signal further comprises:

identifying a reverberant property of an artificial reality environment of the listener; and adding, to the voice input, reverberation based on the reverberant property of the artificial reality environment of the listener.

18. The method of claim 1, wherein the directivity-attuned voice signal reproduces a dynamic speech directivity of the speaker within the artificial reality environment.

19. The system of claim 7, wherein the directivity-attuned voice signal reproduces a dynamic speech directivity of the speaker within the artificial reality environment.

20. The computer-readable medium of claim 13, wherein the directivity-attuned voice signal reproduces a dynamic speech directivity of the speaker within the artificial reality environment.

* * * * *